US005158049A

United States Patent [19]

Neumann

[11] Patent Number: 5,158,049

[45] Date of Patent: Oct. 27, 1992

[54] CONTROL ARRANGEMENT FOR CYLINDER VALVES OF AN INTERNAL COMBUSTION ENGINE HAVING A DEACTIVATABLE CAM

[75] Inventor: Joachim Neumann, Braunschweig, Fed. Rep. of Germany

[73] Assignee: Volkswagen AG, Fed. Rep. of Germany

[21] Appl. No.: 830,179

[22] Filed: Jan. 31, 1992

[30] Foreign Application Priority Data

Feb. 1, 1991 [DE] Fed. Rep. of Germany ..... 4102968

[51] Int. Cl.[5] ..... F01L 1/04

[52] U.S. Cl. ..... 123/90.17; 123/90.6; 74/567; 74/568 R

[58] Field of Search ..... 123/90.15, 90.17, 90.18, 123/90.6; 74/567, 568 R

[56] References Cited

U.S. PATENT DOCUMENTS

| | | | |
|---|---|---|---|
| 4,730,588 | 3/1988 | Maeda | 123/90.6 |
| 4,794,893 | 1/1989 | Masuda et al. | 123/90.17 |
| 4,870,872 | 10/1989 | Parsons | 123/90.17 |
| 4,886,022 | 12/1989 | Nakai | 123/90.17 |
| 5,105,679 | 4/1992 | Voigt | 74/567 |

FOREIGN PATENT DOCUMENTS

| | | | |
|---|---|---|---|
| 3732687 | 4/1988 | Fed. Rep. of Germany | 123/90.17 |
| 3920938 | 1/1990 | Fed. Rep. of Germany . | |

*Primary Examiner*—E. Rollins Cross
*Assistant Examiner*—Weilun Lo
*Attorney, Agent, or Firm*—Brumbaugh, Graves, Donohue & Raymond

[57] ABSTRACT

Deactivatable cams on a camshaft are axially displaceable thereon by changes in pressure of a hydraulic medium in an adjacent pressure space. The deactivatable cams are axially displaced for engagement of cam-specific couplings which establish a rotationally fixed connection between the cams and the camshaft. To make certain that disengagement of the couplings will not occur until the corresponding valves are in the closed position, the couplings include claws with flanks which are inclined from base to apex so that, during the closing motion of the valves, the torque exerted by the valve-closing spring on the cam is partially transformed into an axial force which causes disengagement of the corresponding coupling when the pressure in the adjacent pressure space is reduced. To store increased pressure when engagement of the couplings is to be maintained, one wall of each pressure space is acted on by a compression spring.

2 Claims, 2 Drawing Sheets

CONTROL ARRANGEMENT FOR CYLINDER VALVES OF AN INTERNAL COMBUSTION ENGINE HAVING A DEACTIVATABLE CAM

BACKGROUND OF THE INVENTION

This invention relates to arrangements for controlling the activation of deactivatable cams for the cylinder valves of an internal combustion engine.

German Offenlegungsschrift No. 39 20 938 discloses an arrangement for selectively controlling the operation of the cylinders of an internal combustion engine either by nonactuation of the valves for those cylinders or, in the case of cylinders having several inlet valves, closing selected intake passages by nonactuation of the corresponding valves, i.e., preventing the associated valves from opening at low engine speeds and in the partial-load range. A special advantage of the control arrangement disclosed in this reference is that it permits precise selection of the time of deactivation of the controlled valve. This is important because the deactivation of the selected valve cam must not interfere with the working cycle of the corresponding engine cylinder and, therefore, the deactivation must occur when the valve has at least approximately reached its closed position. The described arrangement obtains this result by a hydraulic circuit which is very simple since it utilizes the torque exerted on the cam by the valve-closing spring at a certain phase of the valve cycle, i.e., toward the end of its closing motion, to generate a force for disengagement of the teeth coupling the valve cam and the camshaft and thereby prepare for deactivation of the cam and its corresponding valve.

Since the valve cam is deactivated by the force exerted by the valve on the cam in accordance with its phase of operation, any difficulties which might occur regarding synchronization of the disengagement of the cam coupling with the working cycle of the valve are avoided.

It is apparent that the coupling between the cam and the camshaft must engage very rapidly to activate the cam and the corresponding valve, especially at high engine speeds.

SUMMARY OF THE INVENTION

Accordingly, it is an object of the present invention to provide a control arrangement for cylinder valves having a deactivatable cam which overcomes the disadvantages of the prior art.

Another object of the invention is to improve the prior art arrangement described above while preserving its advantages with respect to rapid engagement of the coupling.

These and other objects of the invention are attained by providing a control arrangement for a deactivatable cam for a cylinder valve of an internal combustion engine in which a pressure space is provided between a slide thimble and a slidable sleeve so that increased pressure in the pressure space against the force of a compression spring applied to the slidable sleeve generates an axial force on the slide thimble tending to engage a claw coupling which activates the deactivatable cam.

Thus, according to the invention, even after a pressure is applied to the pressure space which produces the axial force required to engage the claw coupling, motion of the slide thimble so as to engage the claw coupling cannot occur until the claws of the coupling are in a preassigned angular position relative to each other.

This means that a comparatively high pressure in the pressure space can displace the slide thimble only far enough for the faces of the claws to slide one upon another when the claws have not yet come into mutual engagement. The invention thus provides a storage of the high pressure of a hydraulic medium in the pressure space during this phase, until the claws drop in, thereby engaging the coupling. As soon as the relative angular position of the claws permits engagement, the stored high pressure is relieved by enlargement of volume due to displacement of the slide thimble in the direction of engaging the coupling.

According to another aspect, the invention provides a pressure reservoir which permits a continuous increase in the volume of pressure medium required for the claw-engaging operation before engagement of the coupling so that, at the instant of engagement which results from axial motion of the sliding sleeve, the volume of pressure medium required for the corresponding enlargement of the volume of the pressure space is already available.

BRIEF DESCRIPTION OF THE DRAWING

Further objects and advantages of the invention will be apparent from a reading of the following description in conjunction with the accompanying drawing.

DESCRIPTION OF PREFERRED EMBODIMENT

Figure 1:
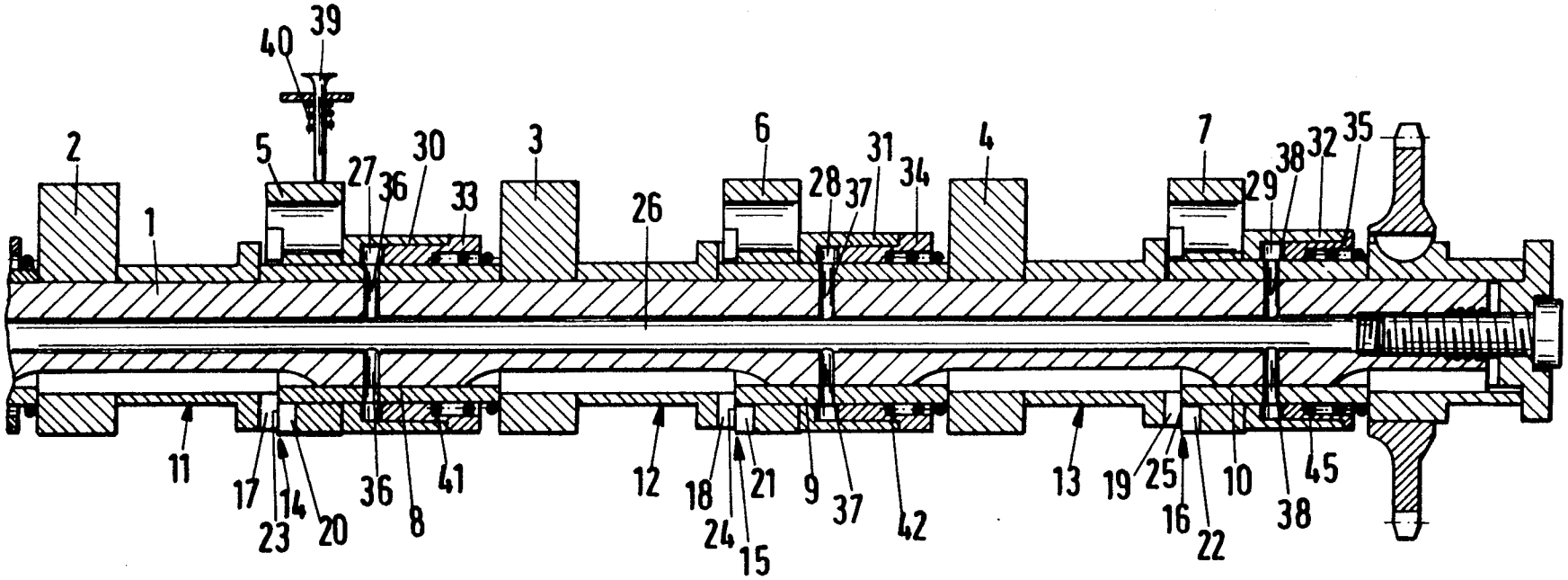
FIG. 1 is a longitudinal sectional view of a representative valve control arrangement in accordance with the invention.

In the typical embodiment of the invention shown in the drawing, a camshaft 1 has three cams 2, 3 and 4 mounted thereon in axially and angularly fixed relation and three deactivatable cams 5, 6 and 7, which may be temporarily fixed in the angular direction with respect to the camshaft 1. In this representative embodiment, the deactivatable cams 5, 6 and 7 are rotatable and axially displaceable on corresponding sleeves 8, 9 and 10, which are rotationally fixed on the camshaft 1 so that they constitute spacer sleeves. Moreover, additional sleeves 11, 12 and 13 which are axially and angularly fixed to the camshaft 1 are mounted between the spacer sleeves 8, 9 and 10. These sleeves constitute bearing supports for the camshaft and also form camshaft-fixed components of corresponding coupling members 14, 15 and 16 for selectively retaining the deactivatable cams 5, 6 and 7 in rotationally fixed position on the camshaft 1. For this purpose, each of the sleeves 11, 12 and 13 is formed at its right end as viewed in the drawing with at least one claw-like projection 17, 18 and 19, respectively, which is arranged to be received in a corresponding groove 20, 21 and 22 provided on the adjacent cam. When so engaged, the projection and groove transmit forces in the angular direction of the camshaft, thus establishing a rotationally fixed connection between the corresponding cam 5, 6 or 7 and the camshaft 1. For this purpose, each of the cams 5, 6 and 7 is likewise provided with a projection 23, 24 and 25, respectively, referred to herein as a claw, extending over the remainder of its left face as viewed in the drawing.

Within the camshaft 1, there is an axial hydraulic oil passage 26 which is closed at the righthand end of the camshaft and three annular pressure spaces 27, 28 and 29 communicating with the passage 26. Oil is supplied to the passage 26 from the lefthand end of the camshaft from a supply (not shown) which reduces the pressure in the passages as a function of engine speed and/or load as described hereinafter when the corresponding cams are to be deactivated for the purpose of shutting off valves.

The annular pressure spaces 27, 28 and 29, which are associated with corresponding cams 5, 6 and 7, are located on the side of the cams away from the corresponding coupling 14, 15 or 16 and are bounded on the lefthand side as viewed in the drawing by corresponding thimbles 30, 31 and 32 which are slidably displaceable on the camshaft. On the right side as seen in the drawing, the individual pressure spaces 27, 28 and 29 are bounded by corresponding sleeves 33, 34 and 35 which are axially displaceable on the camshaft 1 against the force of corresponding springs 41, 42 and 43 so that an increase of the pressure in the central passage 26, transmitted through corresponding transverse passages 36, 37 and 38, will produce an increased pressure in the spaces 27, 28 and 29. At a predetermined relative rotational position of the claw of the corresponding coupling, the increased pressure will cause a displacement of the cams 5, 6 and 7 to the left as seen in the drawing as a result of an axial displacement of the slide thimbles 30, 31 and 32. This displacement produces engagement of the couplings 14, 15 and 16 so that the cams 5, 6 and 7 are coupled in rotationally fixed relation to the camshaft 1 and the corresponding valves are actuated by the cams. Since the actuating arrangement for all three cams 5, 6 and 7 is the same, only the valve 39, which is actuated by the cam 5, and its closing spring 40 are indicated in the drawing.

With this arrangement, all of the cylinders, in the case of engines having several disconnectable cylinders, or the entire inlet flow section, in the case of engines having several inlet valves per cylinder, may be rendered operative under appropriate conditions such as, for example, at high load or high rotational speed.

If certain valves are to be deactivated, however, the corresponding cams 5, 6 and 7 must be moved to the right as seen in the drawing so that the couplings 14, 15 and 16 are disengaged. For this purpose, the pressure applied to the pressure spaces 27, 28 and 29 from the central hydraulic oil passage 26 is reduced so that, when an axial force directed toward the right as seen in the drawing is applied to the cams 5, 6 and 7, the cams and their associated slide thimbles 30, 31 and 32 can move to the right. Such axial forces are derived individually for the cams 5, 6 and 7 from the torque exerted by the corresponding valve-closing spring 40 on the cam, such as the cam 5 shown in the drawing, during the closing motion of the corresponding valve 39. An axial force results from that torque because the claw flanks 50 of the coupling 14, 15 or 16 are inclined so that the claws become narrower from base to apex.

Figure 2:
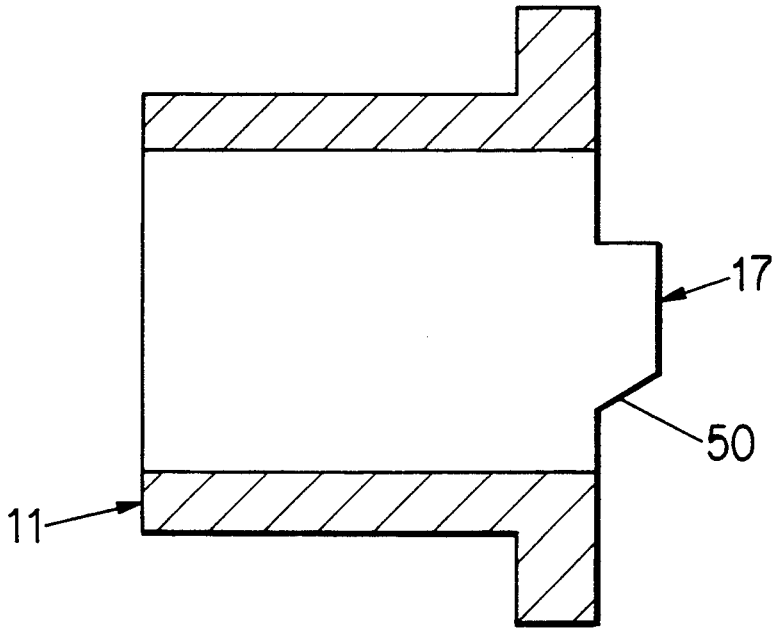
FIG. 2 shows a sleeve with a claw-like projection with an inclined flank.

As set forth in detail in FIG. 2, inclination of a claw flank 50 at an angle greater than the angle of friction at the point of engagement ensures that an axial force acting in the direction of disengagement of the coupling will result from the torque exerted on the cam by the valve-closing spring. Thus, only the reversal of the torque exerted on the cam by the closing spring at the beginning of the closing phase of the lift valve is required to initiate, through the inclined flank, generation of an axial force acting in the direction of disengagement of the coupling. This axial force, however, will lead to disengagement of the coupling and therefore deactivation of the cam only if the pressure in the space on the opposite side of the coupling has been reduced. Further details of this arrangement are described in the above-mentioned Offenlegungsschrift No. 3,920,938.

As previously explained, the claws of the coupling, i.e., the claws 17 and 23 of coupling 14, for example, must not be effective to engage the coupling 14 prior to reaching a selected orientation in the circumferential direction. Resilient pressure reservoirs associated with the pressure spaces 27, 28 and 29 accelerate this process of engagement. For this purpose, a portion of the walls forming the pressure spaces, i.e., the bounding walls formed by the sleeves 33, 34 and 35, are urged by corresponding compression springs 41, 42 and 43 which abut the adjacent rotationally fixed cams 3 and 4 and a drive gear, respectively, in the direction to reduce the volume of the spaces 27, 28 and 29, i.e., to the left as seen in the drawing.

If the pressure of the hydraulic medium applied to the spaces 27, 28 and 29 is increased for the purpose of generating an engaging force for at least one of the couplings 14, 15 and 16, then, prior to engagement of the selected coupling, the increased pressure effects a displacement of the sleeves 33, 34 and 35 toward the right as viewed in the drawing against the action of the springs 41, 42 and 43 so as to enlarge the pressure spaces 27, 28 and 29. In other words, the pressure increase is stored by the enlargement of the pressure spaces in immediate proximity to the couplings 14, 15 and 16. As soon as the claws 17 and 23, for example, have reached the relative rotational position in which their engagement and hence the closing of the coupling 14 occurs, the slide thimble 30, in the assumed example, moves toward the left in the drawing. This displacement is followed by the sleeve 33 in response to the urging of the compression spring 41. Acceleration of the engagement process of the coupling 14 is thereby achieved.

It has been found that the arrangement of the present invention will produce rapid axial displacement of the deactivatable cams even if, as shown, only a single common hydraulic oil passage 26 is provided.

The invention thus provides a deactivatable cam arrangement which permits selective activation and deactivation of cams on a camshaft with angular precision in a simple and convenient manner.

Although the invention has been described herein with reference to a specific embodiment, many modifications and variations therein will readily occur to those skilled in the art. Accordingly, all such variations and modifications are included within the intended scope of the invention.

I claim:

1. A control arrangement for a valve of an internal combustion engine having a closing spring comprising a camshaft, at least one deactivatable cam rotatably mounted on the camshaft, a claw coupling associated with the cam including a slide thimble on the camshaft for establishing a rotationally fixed connection with the camshaft in a first axial position by application of an axial force to the slide thimble and for eliminating the rotationally fixed connection in a second axial position of the slide thimble upon removal of the axial force applied to the slide thimble, the cam and a coupling component which is rotationally fixed on the camshaft having claws arranged to engage each other in the circumferential direction only when the slide thimble is in the first axial position, the claws having flanks which are inclined so as to narrow the claw from the base to the apex at an angle of inclination which is greater than the angle of friction so that torque exerted on the cam by the valve-closing spring during the valve-closing motion of the valve is transformed by the claws into an axial force tending to disengage the coupling, an annular pressure space adjacent to the slide thimble capable of being acted upon by a pressure medium, a pressure medium passage in the camshaft communicating with the annular pressure space, and spring means for applying a force to the annular pressure space tending to maintain pressure therein.

2. A control arrangement according to claim 1 including a sleeve member forming a bounding wall of the annular pressure space on the side away from the coupling, the sleeve member being displaceable on the camshaft relative to the slide thimble so that an increase in pressure in the annular pressure space tends to enlarge the pressure space in the axial direction against the force of the spring means prior to engagement of the coupling.

* * * * *